US005523825A

United States Patent [19]

Satoh et al.

[11] Patent Number: 5,523,825

[45] Date of Patent: Jun. 4, 1996

[54] IMAGE FORMING APPARATUS WITH PRECHARGER

[75] Inventors: Michiaki Satoh; Toru Nose; Mitsuaki Kurokawa; Yoshinori Senoh; Youichirou Gotoh, all of Gifu, Japan

[73] Assignee: Sanyo Electric Co., Ltd., Osaka, Japan

[21] Appl. No.: 308,817

[22] Filed: Sep. 19, 1994

[30] Foreign Application Priority Data

Sep. 17, 1993 [JP] Japan ..... 5-231406

[51] Int. Cl.[6] ..... G03G 15/09; G03G 15/02

[52] U.S. Cl. ..... 355/251; 355/219; 355/270

[58] Field of Search ..... 355/210, 211, 355/246, 251, 253, 269, 270, 219; 118/653, 656–658; 361/220, 225

[56] References Cited

U.S. PATENT DOCUMENTS

| | | | |
|---|---|---|---|
| 4,666,801 | 5/1987 | Kimura et al. | 118/653 X |
| 4,804,994 | 2/1989 | Sasaki et al. | 118/657 X |
| 5,053,821 | 10/1991 | Kunugi et al. | 355/251 X |
| 5,138,387 | 8/1992 | Sato et al. | 355/251 |
| 5,172,163 | 12/1992 | Yamaoki et al. | 355/210 |
| 5,374,978 | 12/1994 | Asanae et al. | 355/210 |
| 5,424,811 | 6/1995 | Haneda | 355/251 |

*Primary Examiner*—William J. Royer
*Attorney, Agent, or Firm*—Darby & Darby

[57] ABSTRACT

An image forming apparatus includes a photoreceptor, and a developing unit arranged in the vicinity of the photoreceptor. At an upstream side from the developing unit, a precharger is provided in a manner that the same is brought into contact with a surface of the photoreceptor. A developing bias voltage is applied to a developing sleeve, and a charging voltage is applied to the precharger. After the photoreceptor is charged by the precharger, the surface of the photoreceptor is brought into contact with a magnetic brush formed by a developing agent in which an insulative toner and a semiconductive magnetic carrier is mixed, whereby the photoreceptor is charged again by the developing bias voltage through the semiconductive magnetic carrier.

15 Claims, 11 Drawing Sheets

IMAGE FORMING APPARATUS WITH PRECHARGER

BACKGROUND OF THE INVENTION

1. Field of the Invention

The present invention relates to an image forming apparatus. More specifically, the present invention relates to an image forming apparatus which utilizes a so-called charge injection type electrophotographic process in which processes such as charging, exposure, development, cleaning, etc. can be carried out almost simultaneously.

2. Description of the Prior Art

A conventional charge injection type of image forming apparatus is disclosed in, for example, Japanese Patent Application Laying-Open No. 58(1983)-153957. FIG. 1 is an illustrative view showing one example of this prior art image forming apparatus.

The prior art image forming apparatus 1 is constructed by arranging a developing unit 3 above the outer periphery of the photoreceptor 2 and a transfer unit 4 below the outer periphery of the photoreceptor 2 as well as arranging an LED array head 5 inside the photoreceptor 2. The photoreceptor 2 includes a cylindrical transparent substrate 2*a* made of a glass, and a transparent electrode 2*b* and a photoconductive layer 2*c*, which constitutes a photoconductive member, are laminated on an outer periphery of the substrate 2*a*. A voltage (V) of approximately 20 volts is applied as a developing bias voltage between the transparent electrode 2*b* and a magnetic roller 6 constituting the developing unit 3. A conductive magnetic toner 7 is absorbed onto a periphery of a developing sleeve 8 covering an outer periphery of the magnetic roller 6, whereby a so-called magnetic brush is formed. An ear end of the magnetic brush 9 is substantially brought into contact with an outer periphery of the photoconductive layer 2*c*. Therefore, an electric charge is injected into the photoconductive layer 2*c* from the developing bias voltage source through the conductive magnetic toner 7 so that the photoconductive layer 2*c* is charged to approximately the same potential as the developing bias voltage.

On the other hand, a light image projected from the LED array head 5 is incident on the photoconductive layer 2*c* from an inside of the cylindrical transparent substrate 2*a* to form an electrostatic latent image on the photoconductive layer 2*c*. At this time, the toner 7 is adhered on the surface of the photoconductive layer 2*c* from the magnetic brush 9, and therefore, a toner image is formed. The toner image is transferred onto a recording paper by the transfer unit 4. Then, remaining toners on the surface of photoreceptor 2 are removed by a cleaning force of the developing unit 3 and a magnetic force of the magnetic roller 6. Consequently, processes such as charging, exposure, development, cleaning and etc. are almost simultaneously carried-out by the developing unit 3 and the LED array head 5, and therefore, structure of an image forming apparatus as well as electrophotographic process can be significantly simplified.

In the above described method where the conductive magnetic toner is utilized in the charge injection type electrophotographic process, in a case of a direct transfer system in which the toner image is directly transferred onto the recording paper, it is required to use a high-resistance recording paper which is obtained by coating a specific material on a plain paper, and therefore, there is a problem that it is impossible to use a plain paper.

In addition, in a case of an indirect transfer system in which the toner image is transferred onto the recording paper via an intermediate member, although a plain paper can be used, the toner image formed on the photoreceptor must be transferred onto a plain paper via the intermediate transfer member such as a transfer belt, and therefore, components such as a cooling device for the transfer belt, a cleaning device for remaining toners on the transfer belt, a zigzag preventing device for the transfer belt, etc. are required. Consequently, there is a disadvantage that an image forming apparatus becomes large and a driving system thereof becomes complex.

Then, in, for example, Japanese Patent Publication No. 5(1993)-38950, there is disclosed a technique in which the toner image can be directly transferred onto a plain paper in the charge injection type electrophotographic process by utilizing a developing agent in which a conductive carrier and an insulative toner are mixed with a predetermined ratio.

In the prior art disclosed in Japanese Patent Publication No. 5-38950, since all charging amount necessary for developing is injected to the photoreceptor via the developing agent, a so-called background fog phenomenon occurs. More specifically, in this prior art device, since the insulative toner is first adhered to the photoreceptor, and resultingly, it becomes difficult for the photoreceptor to be charged, and therefore, there occurs a potential difference between the photoreceptor and the developing sleeve. Accordingly, the so-called background fog phenomenon occurs wherein the insulative toner is adhered at a surface of a non-image portion, i.e., a non-exposed portion.

SUMMARY OF THE INVENTION

Therefore, a principal object of the present invention is to provide a novel image forming apparatus.

Another object of the present invention is to provide an image forming apparatus utilizing a charge injection type electrophotographic process, in which a toner image can be directly transferred onto a plain paper, and no background fog occurs.

An image forming apparatus according to the present invention comprises: a photoreceptor including a substrate and a photoconductive layer laminated on the substrate. A storing means is provided in the vicinity of the photoconductive layer of the photoreceptor that stores a developing agent in which an insulative toner and a semiconductive magnetic toner are mixed. A developing means brings the developing agent stored in the storing means into contact with the photoreceptor to charge the photorecptor. There is also an exposure means which irradiates an exposure light to the photoconductive layer at a portion where the developing agent is brought into contact with the photoreceptor by the developing means and a developing bias means which applies a predetermined developing bias voltage between the developing means and the photoconductive layer. A precharger means is substantially brought into contact with the surface of the photoreceptor at an upstream side from the developing means in view of the photoreceptor and applies a predetermined charging voltage to the photoreceptor prior to the photoreceptor being charged by the developing means.

The photoreceptor is charged by the precharger means, which includes a conductive sheet or conductive blade, to the surface potential or the charged voltage of −500—600 volts, for example. When an area of the photoreceptor charged by the precharger means is brought to the developing means, the photoreceptor is charged again to −400 volts, for example, by the developing bias voltage applied to a developing sleeve, for example, of the developing means via the semiconductive magnetic carrier included in the developing agent. At that time, a nonuniformity of charge by the precharger means is made uniform or even. Then, when the photoreceptor is charged by the developing means, the exposure light is irradiated in the area by the exposure means. Therefore, a toner image is formed by the insulative toner on the photoreceptor.

The area of the photoreceptor which has been the precharger means holds the predetermined charged voltage or potential until the area is charged again by the developing means. Therefore, since no potential difference exists between the photoreceptor and the insulative toner included in the developing agent, the insulative toner is not adhered to a non-exposed portion, i.e. non-image portion. Therefore, no background fog occurs.

In accordance with the present invention, since the toner image is formed by only the insulative toner, the toner image can be directly transferred onto a plain paper. Furthermore, since the photoreceptor is charged in advance to the predetermined voltage by the precharger means prior to the photoreceptor being charged by the developing means, no background fog occurs.

The above described objects and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
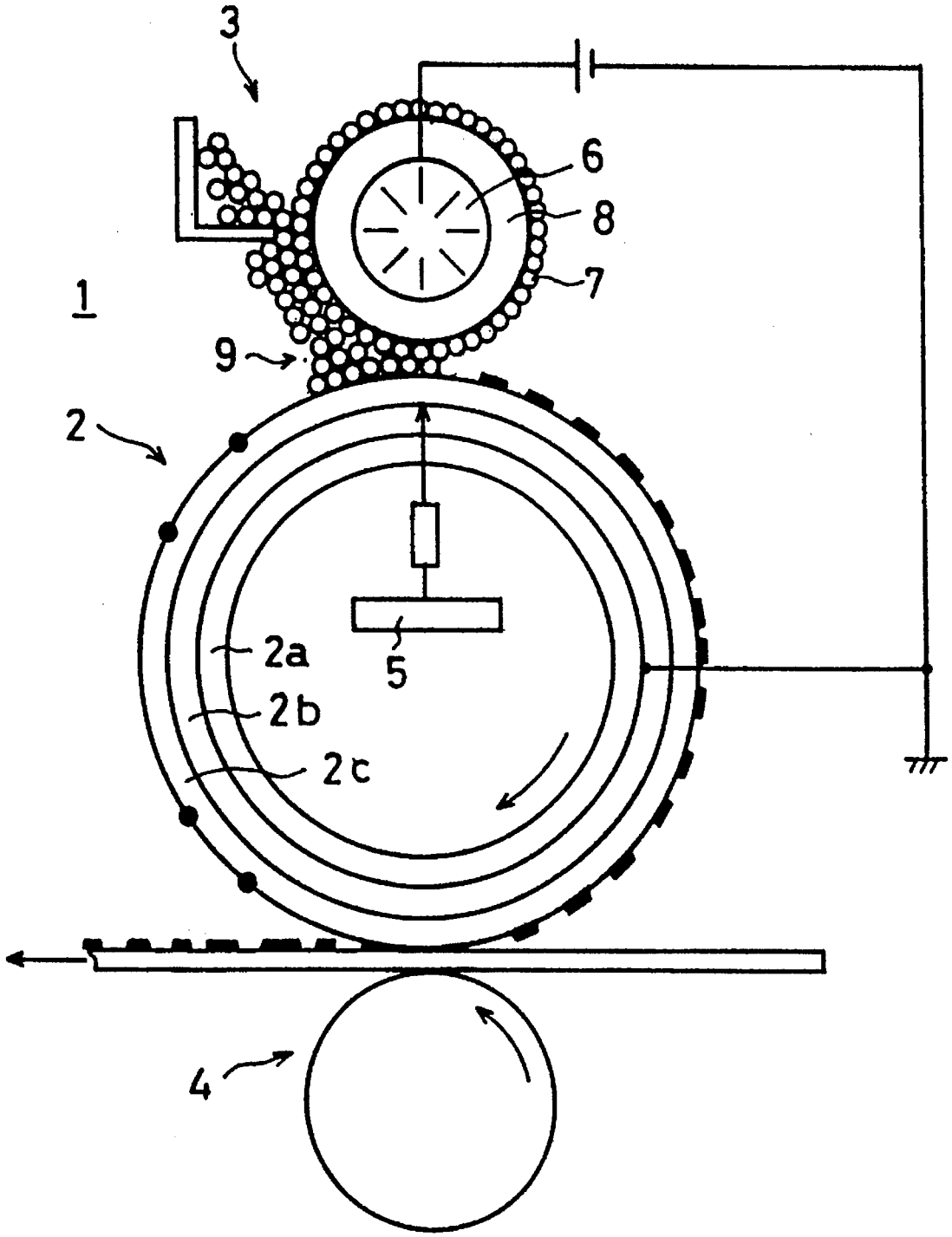
FIG. 1 PRIOR ART
FIG. 1 is an illustrative view showing one example of a prior art image forming apparatus utilizing a charge injection type electrophotographic process.
Figure 2:
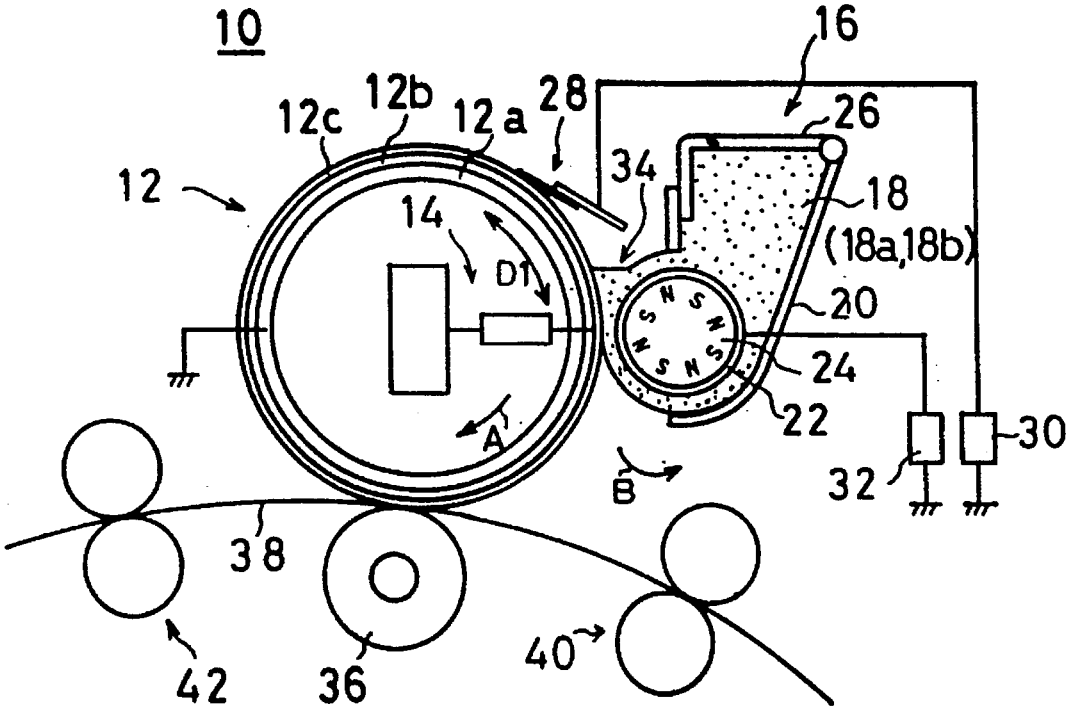
FIG. 2 is an illustrative view showing one embodiment according to the present invention.

An image forming apparatus 10 of the embodiment shown in FIG. 2 includes a photoreceptor 12 which is similar to the photoreceptor 2 of the prior art image forming apparatus 1 described referring to FIG. 1. The photoreceptor 12 includes a transparent substrate 12*a* made of a cylindrical glass, and a transparent electrode 12*b* and a photoconductive layer 12*c* respectively laminated, in the preferred embodiment, on an outer periphery of the substrate 12*a* each with respective predetermined thickness. The photoreceptor 12 is rotated in a clockwise direction, i.e. an arrow mark A direction by a driving force of a main motor (not shown). Inside the photoreceptor 12 is an optical writing head 14 which includes an LED array head, for example, that irradiates an exposure light to the photoconductive layer 12*c* through the transparent substrate 12*a* and the transparent electrode 12*b*.

A developing unit 16 is provided in the vicinity of a surface of the photoconductive layer 12*c* of the photoreceptor 12. The developing unit 16 includes a developing agent box or toner box 20 in which a developing agent 18 obtained by mixing an insulative toner 18*a* and semiconductive magnetic carrier 18*b* is stored. A developing sleeve 22 covering a magnetic roller 24 is arranged at a lower end opening of the toner box 20. The developing sleeve 22 is a non-magnetic cylindrical member made of aluminum, stainless steel and etc., and the magnetic roller 24 is fixedly arranged inside the developing sleeve 22. Magnetic poles N and S, eight (8) for example being shown, are alternately formed on a surface of the magnetic roller 24. The developing sleeve 22 is rotated in a counterclockwise direction, i.e. an arrow mark B direction, by a driving mechanism (not shown). The developing sleeve 22 is arranged at a position opposite to the optical writing head 14 so as to sandwich the photoreceptor 12.

In addition, an upper end opening of the toner box 20 is closed by a lid 26. Therefore, by opening or closing the lid 26, the insulative toner 18*a* is refilled or supplemented in the toner box 20. More specifically, a mixing ratio of the insulative toner 18*a* and the semiconductive magnetic carrier 18*b* in the developing agent 18 stored in the toner box 20 is lowered as the number of times the image forming processes increases, that is, according to a printing quantity. If the mixing ratio becomes less than a predetermined value, the image density is lowered. At a time that a user determines that the image density is lowered, the user opens the lid 26 to refill or supplement the insulative toner by a predetermined amount. In this case, instead of the determination by the user, a drop of the mixing ratio may be detected by a sensor, or a drop of the mixing ratio may be detected on the basis of a developing current.

In addition, in an initial state, the toner box 20 is filled by the developing agent 18 with no air gap. If the image forming process is repeatedly executed, the insulative toner 18*a* is consumed, and the volume of the developing agent 18 within the toner box 20 is reduced. Accordingly, an air gap is formed at an upper portion of the inside of the toner box 20. Then, if the above described toner time of supplement is detected, the insulative toner is supplemented such that the user supplements the above described air gap of the toner box 20 by the insulative toner 18*a*. Therefore, the user does not over-supplement the insulative toner. That is, it is always possible to supplement the insulative toner up to a most suitable amount. Even if the insulative toner is supplemented but the air gap of the toner box 20 is not filled, the next toner supplement timing comes soon but no problem occurs.

In the image forming apparatus 10 of the FIG. 2 embodiment, a precharger 28 is arranged at a position separated from the developing unit 16 by predetermined distance D1 at an upstream side from the developing unit 16 in view of the photoreceptor 12 in a manner that the precharger 28 is brought into contact with a surface of the photoconductive layer 12*c* of the photoreceptor 12. In this embodiment as shown, the precharger 28 is formed by a conductive film having a main surface which is brought into contact with the surface of the photoreceptor 12. A predetermined charging voltage, of a negative polarity for example, is applied to the precharger 28 by a charging voltage source 30. Furthermore, a predetermined developing bias voltage, of a negative polarity, for example, is applied to the developing sleeve 22 by a developing bias voltage source 32. In the embodiment the charging voltage of the negative polarity is illustratively –900—1000 volts larger than the developing bias voltage that is –400 volts, for example. Thus, the difference in the voltage applied to the developing unit 16 and that applied to the precharger 28 by the charging voltage source 30, and results in the surface potential or charged voltage of the photoreceptor 12 being different by –500—600 volts. In addition, it is desirable that the voltage applied to the precharger 28 is a voltage by which the charged potential of the photoreceptor 12 is equal to or larger than the developing bias voltage.

Furthermore, as a material for forming the substrate 12*a* of the photoreceptor 12, an arbitrary material having a good light-permeability or transparency and no optical distortion can be utilized, and therefore, glass such as brosilicate glass, and resin such as acrylic resin, polycarbonate resin, etc. can be used. Furthermore, as the transparent electrode 12*b*, indium tin oxide (ITO), tin oxide and etc., for example, can be utilized. In order to form the transparent electrode 12*b*, it is possible to utilize a method such as vapor deposition method, spattering method, painting method, dipping method, etc. Furthermore, as the photoconductive layer 12*c*, a photoconductive material such as a selenium compounds, amorphous silicon, organic resin and etc. can be utilized.

Furthermore, the thickness of the substrate 12*a* may be larger than 0.1 mm. A substrate 12*a* having a thickness within a range of 0.1 mm–1 mm has an elasticity to some extent and , even when accuracy such as straightness, deviation from cylindrical form, etc., of the substrate 12*a* is not so good, the substrate can be forcedly corrected to a desired form by a pressure from the magnetic roller 24.

In the image forming apparatus 10, the photoreceptor 12 is charged to a voltage close to the developing bias voltage by the precharger 28, and thereafter, the photoreceptor 12 is rotated. Therefore, an area charged by the precharger 28 is brought to a position opposite to the developing unit 16 while the area holds the charged voltage or potential.

On the other hand, when the developing sleeve 22 is rotated, the semiconductive magnetic carrier 18*b* attracted to the developing sleeve 22 by magnetic forces of the S poles and the N poles of the magnetic roller 24 is moved according to the rotation of the developing sleeve 22. Furthermore, the insulative toner 18*a* coupled to the semiconductive magnetic carrier 18*b* due to a Coulomb force is also withdrawn from the low end opening of the toner box 20 according to the rotation of the developing sleeve 22, and comes opposite to the surface of the photoconductive layer 12*c* of the photoreceptor 12.

Figure 3:
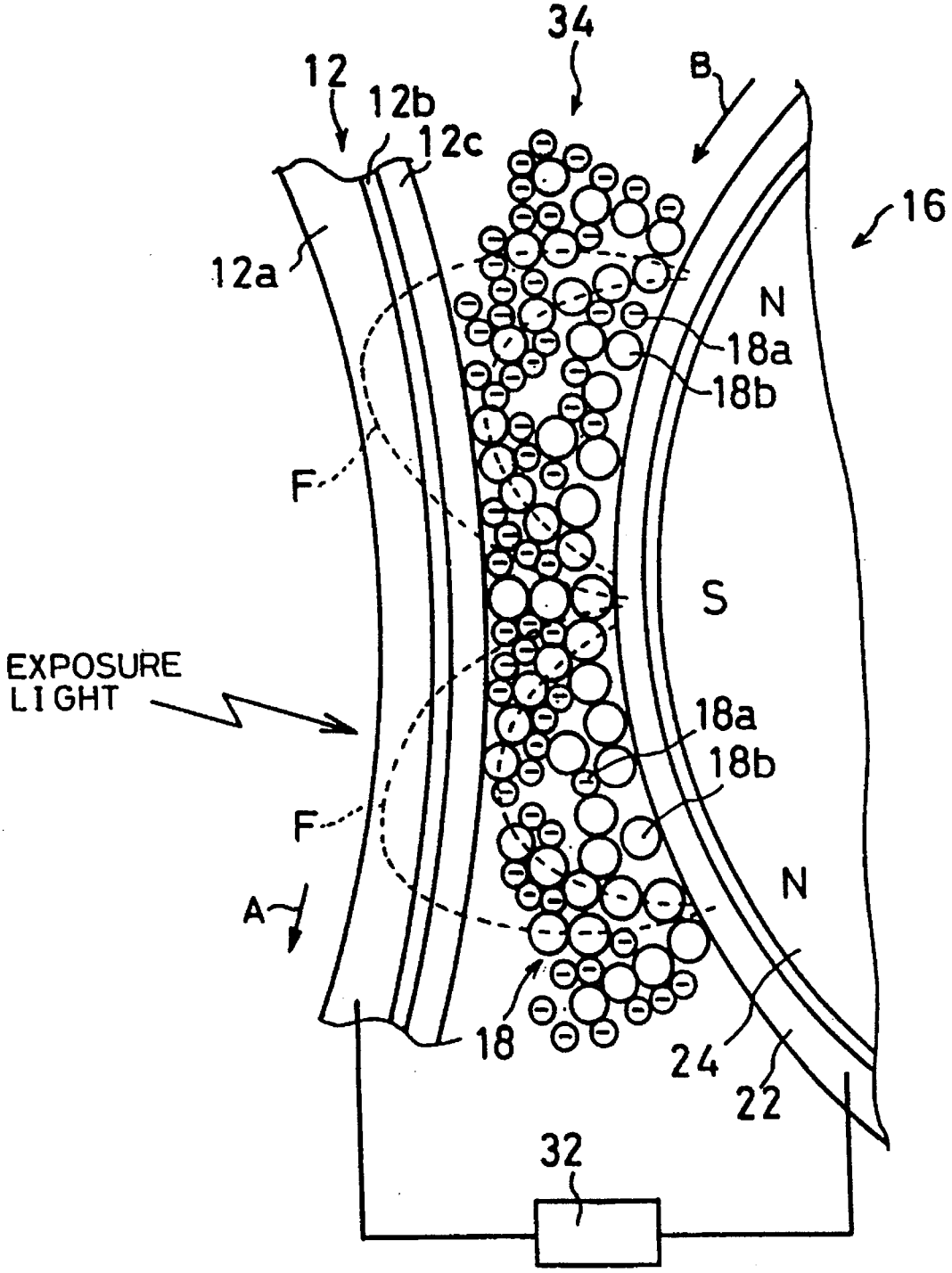
FIG. 3 is an illustrative view showing respective processes of charge injection, exposure and developing in the FIG. 2 embodiment.

Reference FIG. 3 shows in more detail a magnetic brush 34 of the developing agent 18 composed of the semiconductive magnetic carrier 18*b* and the insulative toner 18*a* adhered to the semiconductive magnetic carrier 18*b* by a local Coulomb force. This occurs by a friction charge with the semiconductive magnetic carrier 18*b* formed along magnetic force lines F between the N poles and the S poles which are alternately formed in a peripheral direction on the outer periphery of the magnetic roller 24 of the developing unit 16. Then, in the magnetic brush 34 of the developing agent 18, an electric conductive path is formed by the semiconductive magnetic carrier 18*b*, a chain of the carriers 18*b*, and the charge injection to the surface of the photoreceptor 12 is performed during a time that the surface of the photoreceptor 12 is brought into contact with the magnetic brush 34 until the surface voltage becomes the same potential as the developing bias voltage of the developing bias voltage source 32. Therefore, the surface of the photoreceptor 12 and the developing sleeve 22 become the same potential and the same polarity, and accordingly, a Coulomb force which acts on the insulative toner 18*a* becomes zero, and therefore, an electric force by which the insulative toner 18*a* is adhered to the photoreceptor 12 fails to exist.

Figure 4:
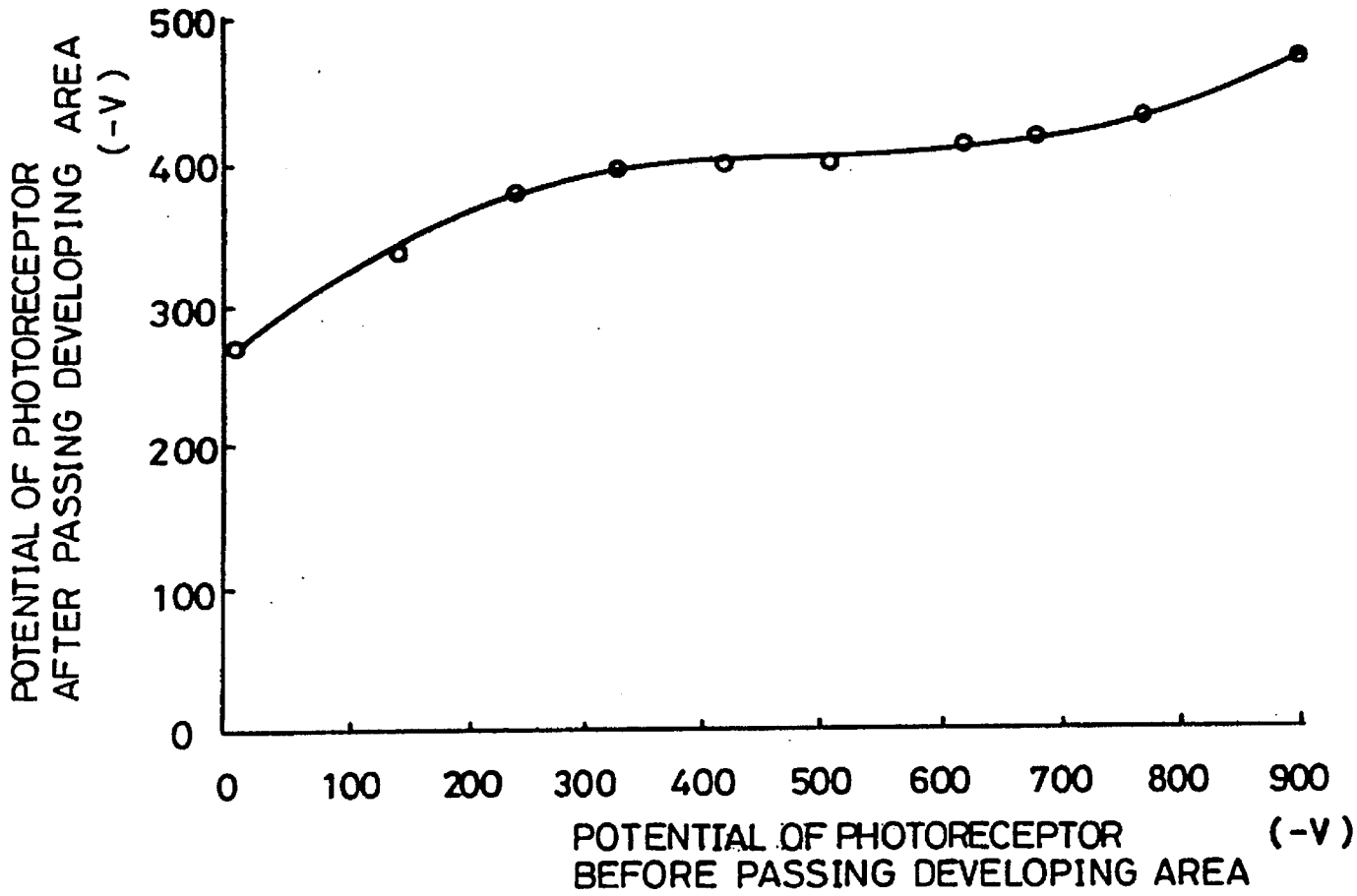
FIG. 4 is a graph showing a charged voltage, or potential, of a photoreceptor before and after the photoreceptor is passed through a developing area in the FIG. 2 embodiment.

FIG. 4 is a graph showing the charged voltage of the photoreceptor 12 before and after the photoreceptor 12 is brought into contact with the magnetic brush 34. After the photoreceptor 12 is charged to the voltage close to the developing bias voltage by the precharger 28, by bringing the photoreceptor 12 into contact with the magnetic brush 34, the photoreceptor 12 is charged at approximately the same potential as the developing bias voltage (–400 volts, in this embodiment shown) of the developing unit 16. That is, the charged potential of the photoreceptor 12 finally becomes equal to the developing bias voltage. Therefore, the nonuniformity of the charge by the precharger 28 is made even, or uniform, by the charge injection from the magnetic brush 34, and therefore, a specific control is not needed in charging the photoreceptor 12 by the precharger 28.

If the photoreceptor 12 is thus charged at the same potential as the developing voltage, i.e. the potential of the developing agent 18, an electric attracting force between the developing agent 18 and the photoreceptor 12 does not occur, and therefore, no developing agent is adhered on the surface of the photoconductive layer 12*c* of the photoreceptor 12. That is, if the charged potential of the photoreceptor 12 after the same is brought into contact with the magnetic brush 34 is approximately the same potential as the developing bias voltage or larger than the developing bias voltage, since the insulative toner 18*a* is not adhered to the surface of the photoreceptor 12, it is possible to set the charged potential of the photoreceptor 12 by the precharger 28 in a range wider than that of a normal electrophotographic process in which a corona charger is utilized. Specifically, even if the charged potential of the photoreceptor 12 by the precharger 28 is smaller than the developing bias voltage, when a potential difference between the charged voltage and the developing bias voltage is made smaller to some extent, the charged potential of the photoreceptor 12 becomes the same potential as the developing bias voltage by the charge injection from the magnetic brush 34, and therefore, no background fog occurs. Furthermore, if the charged potential of the photoreceptor 12 by the precharger 28 is larger than the developing bias voltage, the background fog, of course, does not occur.

The photoreceptor 12 thus charged is exposed by the optical writing head 14. Due to the exposure light from the optical writing head 14, the potential of the area which receives the exposure light is lowered, a potential difference between the photoreceptor 12 and the developing agent 18 is generated at that portion, and therefore, an electric force occurs such that the insulative toner 18*a* of the developing agent 18 is adhered to the portion of the photoreceptor 12. At this time, since the semiconductive magnetic carrier 18*b* is almost never charged, the electric force between the semiconductive magnetic carrier 18*b* and the surface of the photoreceptor 12 is weaker than the magnetic force between the semiconductive magnetic carrier 18*b* and the developing sleeve 22, and therefore, the semiconductive magnetic carrier 18*b* remains on the developing sleeve 22.

In contrast, since the insulative toner 18*a* is charged in a predetermined polarity (negative polarity, for example) due to the friction between the insulative toner 18*a* and the semiconductor magnetic carrier 18*b*, a sufficiently large electric force is generated between the insulative toner 18*a* and the photoreceptor 12, and resultingly, the insulative toner 18*a* is moved toward the area of the photoreceptor 12 where the potential is lowered due to the irradiation of the exposure light and adhered thereto because the electric force overcomes the Coulomb force between the insulative toner 18*a* and the semiconductive magnetic carrier 18*b*. That is, a toner image is formed on the photoreceptor 12 only by the insulative toner 18*a* included in the developing agent 18.

Then, as shown in FIG. 2, the toner image formed on the photoreceptor 12 is moved to a transfer position facing a transfer roller 36, and transferred onto a recording paper 38 which is fed by a paper feeding roller 40. At the transfer position, the insulative toner 18*a* adhered to the photoreceptor 12 is transferred onto the recording paper 38 by an electric force of the transfer roller 36 to which a transfer bias voltage of +500 volts, for example, of a polarity opposite to the charging polarity. Thereafter, the recording paper 38 is fed to a fixing roller 42, and the toner image is fixed to the recording paper 38.

The photoreceptor 12 is further rotated. Toner which remains on the surface of the photoreceptor 12 after the transfer process reaches a position of the precharger 28, a physical force is applied to the remaining toner by the precharger 28, and therefore, the remaining toner is disturbed. Furthermore, an electrostatic force of the remaining toner is reduced by the charge by means of the precharger 28. Therefore, adhesive force between the remaining toner and the photoreceptor 12 is made weak. Thereafter, when the remaining toner reaches the developing unit 16 with further rotation of the photoreceptor 12, since the adhesive force between the remaining toner and the photoreceptor 12 is made weak, the remaining toner is attracted by the semiconductive magnetic carrier 18*b* included in the magnetic brush 34, and resultingly, the remaining toner is recovered by the developing unit 16 (cleaning process). That is, the precharger 28 functions as a remaining toner separating member.

In the above described embodiment, ranges suitable for a resistivity of the semiconductive magnetic carrier 18*b* and an average particle diameter of the semiconductive magnetic carrier 18*b* that are features of the embodiment, respectively, are confirmed as shown in the following tables 1 and 2.

TABLE 1

| | Resistivity | $10^1$ | $10^2$ | $10^3$ | $10^4$ | $10^5$ | $10^6$ | $10^7$ | $10^8$ | $10^9$ | $10^{10}$ |
|---|---|---|---|---|---|---|---|---|---|---|---|
| Evaluation Items | (1) Potential variation of non-image portion | ◎ | ◎ | ◎ | ◎ | ◎ | ◎ | ◎ | ○ | Δ | X |
| | (2) Image density | ○ | ○ | ○ | ○ | ○ | ○ | ○ | ○ | Δ | X |
| | (3) Image quality | X | X | Δ | ○ | ◎ | ◎ | ◎ | ◎ | ◎ | ◎ |
| | (4) Pin-hole effect | X | X | Δ | ○ | ○ | ◎ | ◎ | ◎ | ◎ | ◎ |
| | (5) Charge injection | ◎ | ◎ | ◎ | ◎ | ◎ | ◎ | ◎ | ○ | Δ | X |
| | Total evaluation | X | X | Δ | ○ | ◎ | ◎ | ◎ | ○ | Δ | X |

◎ Excellent
○ Good
Δ No good
X Unusable

TABLE 2

| | Average particle diameter | 15 | 20 | 25 | 30 | 40 | 50 | 60 | 100 |
|---|---|---|---|---|---|---|---|---|---|
| Evaluation Items | (1) Charge injection | ◎ | ◎ | ◎ | ◎ | ◎ | ○ | Δ | Δ |
| | (2) Image quality | ◎ | ◎ | ◎ | ◎ | ○ | ○ | ○ | Δ |
| | (3) Carrier attraction | X | ○ | ○ | ○ | ○ | ◎ | ◎ | ◎ |
| | Total evaluation | X | ◎ | ◎ | ◎ | ◎* | ○* | Δ* | Δ |

◎ Excellent
○ Good
Δ No good
X Unusable
*Evaluated with priority to charge injection In the experimentation for table 1, five (5) evaluation items, i.e. (1) potential variation at non-image portion, (2) image density, (3) image quality, (4) pin-hole effect, and (5) charging injection are evaluated while the resistivity of the semiconductive magnetic carrier is changed within a range of $10^1$–$10^{10}\Omega$.cm·

The potential variation at non-image portion is evaluated on the basis of a variation amount of the potential at the non-image portion on the photoreceptor 12. More specifically, the nonuniformity of charge occurs when the photoreceptor 12 is charged through the contact of the precharger 28 with the photoreceptor 12 as described above, but the nonuniformity of charge is dissolved by the charge injection through the contact of the magnetic brush 34 of the developing agent 18 with the photoreceptor 12. The nonuniformity of charge by the precharger 28 is made to be even, or uniform, at the what degree by the charge injection by the magnetic brush 34 is evaluated on the basis of the potential variation amount at the non-exposed portion, i.e. non-image portion. If the unifromalization by the charge injection by the semiconductive magnetic carrier is small, a stripe pattern occurs in the non-image portion. In table 1, it is indicated that when the resistivity of the carrier is larger than $10^{10}\Omega$·cm, no unifromalization effect is performed, and therefore, the carrier is unusable.

The image density is evaluated by a toner image density at the image portion. In table 1, it is indicated that when the resistivity of the semiconductive magnetic carrier is larger than $10^{10}\Omega\cdot$cm, a drop of the image density is large, and therefore, the carrier is unusable.

The image quality is evaluated on the basis of a sharpness and a fringe at an edge portion of the image. In table 1, it is indicated that when the resistivity of the semiconductive magnetic carrier is smaller than $10^{2}\Omega\cdot$cm, a drop of the image quality is large, and therefore, the carrier is unusable.

The pin-hole effect is evaluated through determination that a pin-hole is affected by what influence of the resistivity of the semiconductive magnetic carrier when the pin-hole is formed in the photoconductive layer 12*c* of the photoreceptor 12. If the pin-hole exists in the photoconductive layer 12*c*, the carrier is brought into contact with the pin-hole, and therefore, the charge is leaked from the pin-hole, and accordingly, the potential of the non-image portion is lowered as if the non-image portion receives the exposure light, and thus, the toner adheres to the non-image portion and, in certain circumstances a stripe pattern occurs in an axial direction of the photoreceptor 12. In table 1, it is indicated that when the resistivity of the semiconductive magnetic carrier is smaller than $10^{2}\Omega\cdot$cm, the leakage of charge is too large, and therefore, the carrier is unusable.

The charge injection is evaluated by the charge injection amount through the semiconductive magnetic carrier. In table 1, it is indicated that when the resistivity of the carrier is larger than $10^{10}\Omega\cdot$cm, the charge injection amount is too small, and therefore, the carrier is unusable.

As a result of the above described evaluation items, as indicated in table 1, the range of the resistivity of the semiconductive magnetic carrier 18*b* suitable for the present invention is $10^{4}$–$10^{8}\Omega\cdot$cm, and more preferably, the range of the resistivity of the semiconductive magnetic carrier 18*b* is $10^{5}$–$10^{7}\Omega\cdot$cm.

Furthermore, in the experimentation shown in table 2, three (3) evaluation items, i.e. (1) charging injection, (2) image quality, and (3) carrier attraction are evaluated while the resistivity of the semiconductive magnetic carrier is fixed at $10^{6}\Omega\cdot$cm and the average particle diameter of the semiconductive magnetic carrier is changed within a range of 15–100 μm.

The charge injection is evaluated by the charge injection amount by the carrier. In table 2, it is indicated that when the average particle diameter of the semiconductive magnetic carrier is larger than 60 μm, the charge injection amount is reduced, and therefore, the carrier is not preferred.

The image quality is evaluated on the basis of the sharpness and the fringe at the edge portion of the image. In table 2, it is indicated that when the average particle diameter of the semiconductive magnetic carrier is larger than 100 μm, the image quality becomes bad, and therefore, the carrier is not preferred.

The carrier attraction is evaluated through determination of the degree that the carrier is attracted to the photoreceptor 12. If the carrier is attracted to the photoreceptor, since the mixing ratio of the toner and the carrier in the developing agent is changed. In table 2, it is indicated that when the average particle diameter of the semiconductive magnetic carrier is smaller than 15 μm, the carrier attraction is large, and therefore, the carrier is unusable.

As a result of the above described evaluation items, as indicated in table 2, it is desirable that the average particle diameter of the semiconductive magnetic carrier 18*b* is within a range of 20–50 μm. In addition, it is confirmed through the experimentation that the range of the above described average particle diameter is applicable to the semiconductive magnetic carrier having the resistivity indicated in table 1, i.e. $10^{4}$–$10^{8}\Omega\cdot$cm.

Furthermore, the mixing ratio of the semiconductive magnetic carrier 18*b* and the insulative toner 18*b* used in the developing agent 18 is to be determined by totally taking the charging characteristic, image forming speed, etc. of the photoreceptor 12 into consideration.

More specifically, since what contributes to the developing in the image forming apparatus 10 of this embodiment is the insulative toner 18*a*, if the ratio of the insulative toner 18*a* is too small, an amount of toners adhered to the image portion of the photoreceptor 12 becomes small, and therefore, it becomes difficult not to obtain a sufficient image density. In contrast, if the ratio of the insulative toner 18*a* becomes too large, it becomes difficult for the semiconductive magnetic carrier 18*b* to form the conductive path (FIG. 3), and therefore, the charging efficiency for the photoreceptor 12 is lowered. Therefore, it is desirable that a weight ratio of the insulative toner 18*a* with respect to the developing agent 18 in which the semiconductive magnetic carrier 18*b* and the insulative toner 18*a* are mixed is to be within a range of 5–95%.

In the above described embodiment, the developing agent 18 is accumulated at the upstream side with respect to the rotation direction of the photoreceptor 12; however, it is desirable that this accumulation amount is so adjusted that a developing nip width, i.e. a contacting width between the photoreceptor 12 and the magnetic brush 34 (FIG. 3) becomes 4–15 mm. If the developing nip width is less than 4 mm, the charge injection by the developing agent 18 becomes insufficient, and therefore, it becomes difficult to uniformly charge the photoreceptor 12, and accordingly, background fog occurs due to the nonuniformity of the charge. Furthermore, if the developing nip width becomes more than 15 mm, since an upper layer portion of the developing agent 18 as accumulated is brought into contact with the surface of the photoreceptor 12 prior to when the charge injection is performed by the magnetic brush 34, a portion of the photoreceptor 12 where the charging potential by the precharger 28 is low, the magnetic force of the magnetic roller 24 to the developing agent 18 as accumulated is weak, and accordingly, the insulative toner 18*a* of the upper layer portion of the accumulated developing agent is adhered to the photoreceptor 12. At this time, if an amount of toners adhered to the photoreceptor 12 is large, it occasionally occurs that the surface of the photoreceptor 12 is not cleaned during a time that the surface of the photoreceptor 12 is being passed through the developing nip portion, and therefore, in such a case, background fog occurs. This background fog can be effectively prevented by another embodiment shown in FIG. 5–FIG. 7.

Figure 5:
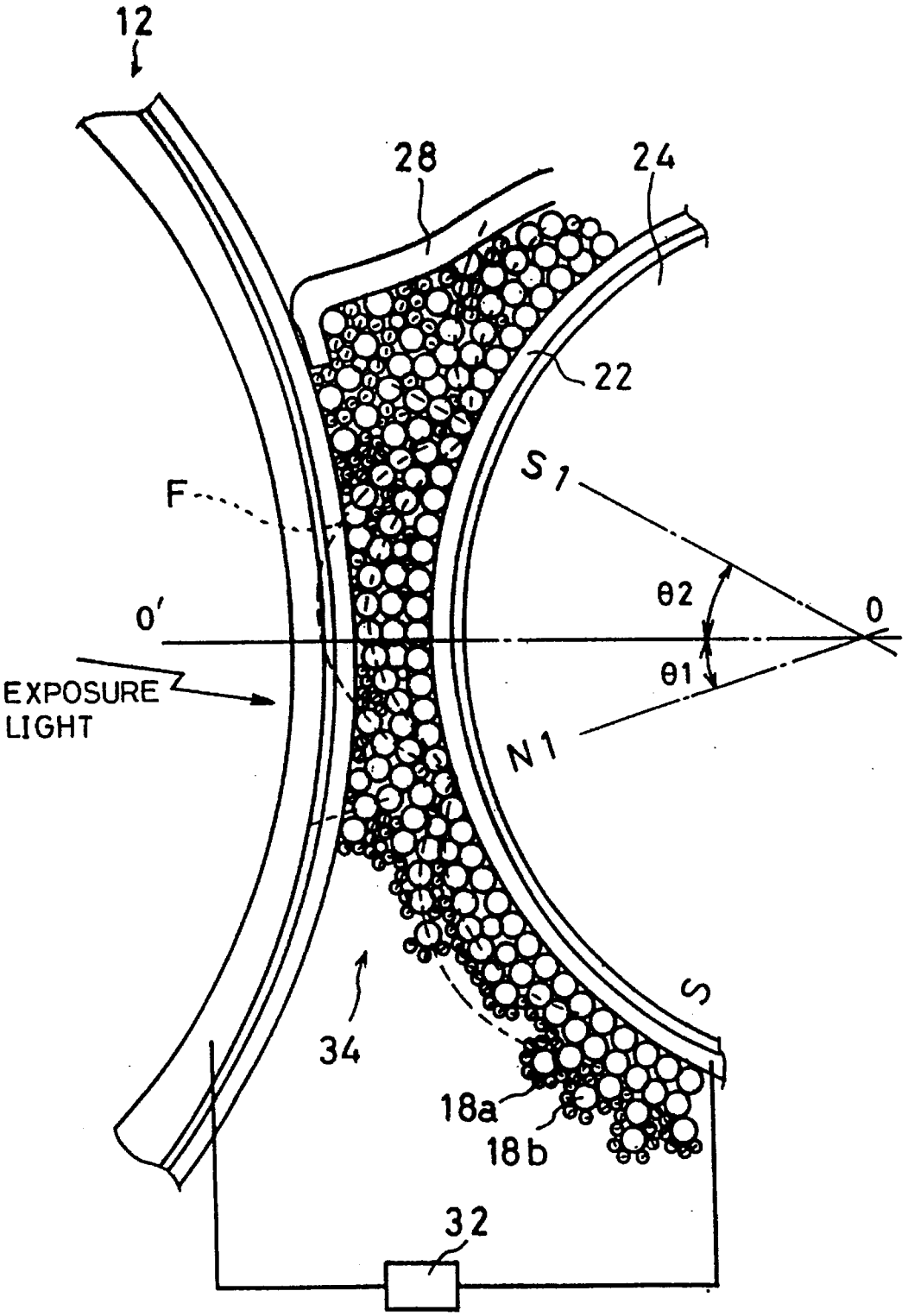
FIG. 5 is an illustrative view showing a major portion of another embodiment according to the present invention.

Next, with reference to FIG. 5 and FIG. 6, another embodiment according to the present invention will be described. As described above, the N poles and the S poles are alternately arranged on the surface of the magnetic roller 24. Then, the N1 poles exists at a downstream side with reference to a position that a gap between the photoreceptor 12 and the developing sleeve 22 becomes minimum, that is, a linear line OO' connecting centers of the photoreceptor 12 and the developing sleeve 22, and the S1 pole exists at an upstream side. Now, on the assumption that an angle formed by a linear line connecting the center O of the developing sleeve 22 and the magnetic pole N1 with the linear line OO' is θ1, and an angle formed by a linear line connecting the center of the developing sleeve 22 and the magnetic pole S1 with the linear line OO' is θ2, in this embodiment shown, the magnetic poles N1 and S1 are arranged such that the angles θ1 and θ2 become θ1≦θ2. In this embodiment shown, the angle θ1 is 18 degrees and the angle θ2 is 27 degrees.

In addition, the position of the magnetic pole means a position that a magnetic flux density of the magnetic pole at the surface of the developing sleeve in a direction of a normal line of the surface becomes maximum.

Figure 6:
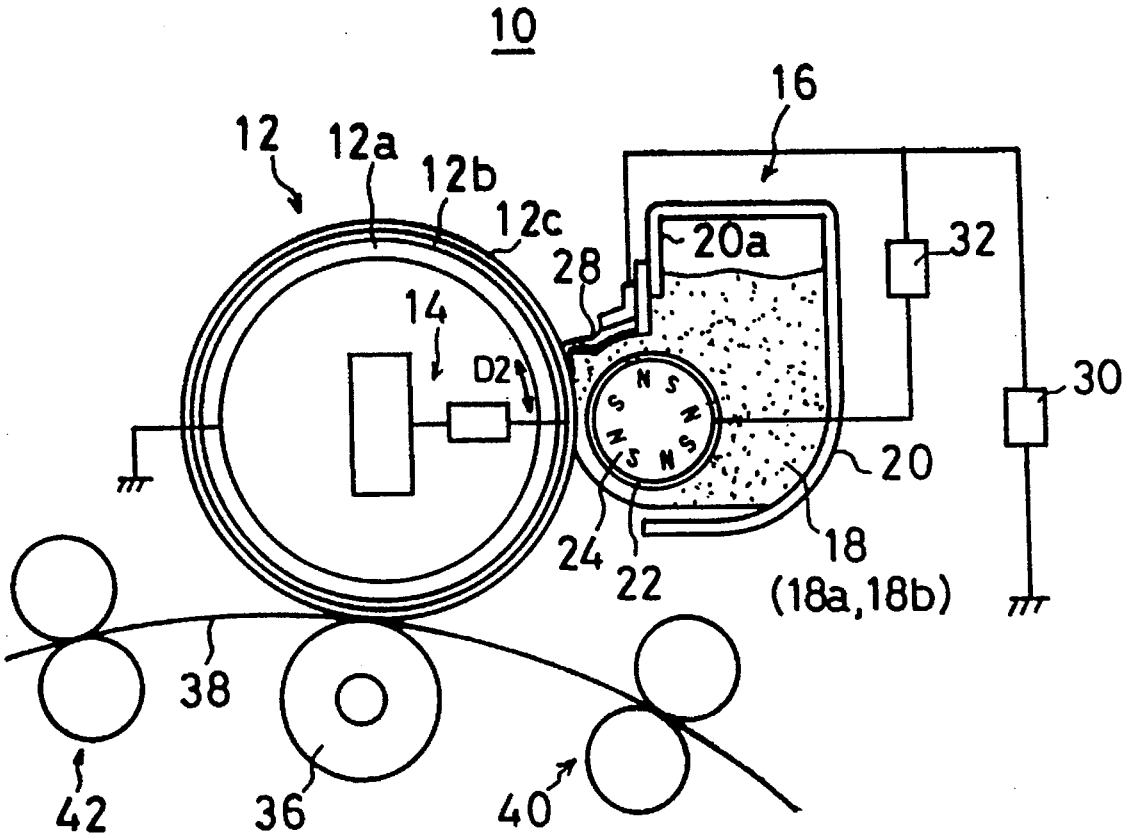
FIG. 6 is an illustrative view showing the FIG. 5 embodiment as a whole.

Furthermore, in this embodiment, it will be understood through comparison of FIG. 6 and FIG. 2 especially that a position of the precharger 28 for charging the photoreceptor 12 is different from that of the previous embodiment. More specifically, in the previous embodiment, the position of the precharger 28 and the position where the magnetic brush 34 is brought into contact with the photoreceptor 12 is largely separated from each other by the distance D1; however, in the embodiment shown, the precharger 28 is arranged at a position separated from the developing unit 16, i.e. the position where the magnetic brush 34 is brought into contact with the photoreceptor 12 with a distance D2. In addition, D1>D2. Therefore, the precharger 28 is arranged very closely to the contacting area of the magnetic brush 34 with the photoreceptor 12, whereby it is possible to prevent the background fog which occurs in the FIG. 2 embodiment from occurring.

More specifically, in a case where the precharger 28 is separated from the position of the magnetic brush 34 as is in the FIG. 2 embodiment, until the area of the photoreceptor 12 charged by the precharger 28 is brought into contact with the magnetic brush 34, the photoreceptor 12 is charged and developed by only the developing bias voltage source 32. Therefore, in this portion, background fog occurs, and therefore, the toner is adhered to the portion. If the toner is adhered to the photoreceptor 12, there occur problems of dirt on the transfer roller 36 and dirt at the rear on the recording paper due to the dirt on the transfer roller 36. However, by varying the distance of the precharger 28 to the magnetic brush 34, it is possible to make the position where the charging is performed by the precharger 28 and the position where the charging performed by the magnetic brush 34 approximately coincident, and therefore, no background fog occurs.

In order to arrange the precharger 28 very closely to the developing unit 16, i.e. the magnetic brush 34, in the embodiment shown in FIG. 6, the precharger 28 is fixed, as illustratively shown, on the upper left end 20*a* of the toner box 20. By fixing the precharger 28 at the upper left end 20*a* of the toner box 20, a dispersion preventing function (described later) by the precharger 28 is demonstrated.

Then, in this embodiment, when the surface of the photoreceptor 12 is brought into contact with the magnetic brush 34, the charge injection to the photoreceptor 12 is performed by the developing bias voltage. At this time, since θ1≦θ2, a center position between the magnetic poles N1 and S1 at which the developing agent 18 becomes densest, that is, a position where the magnetic flux density at the surface of the developing sleeve 22 in the direction of the normal line of the surface exists at the upstream side with reference to the previously described linear line OO', and therefore, the conductive path for charging the photoreceptor 12 becomes dense, and therefore, the charge injection to the photoreceptor 12 is performed with good efficiency and uniformly, and thus, the photoreceptor 12 can be uniformly charged.

Figure 7:
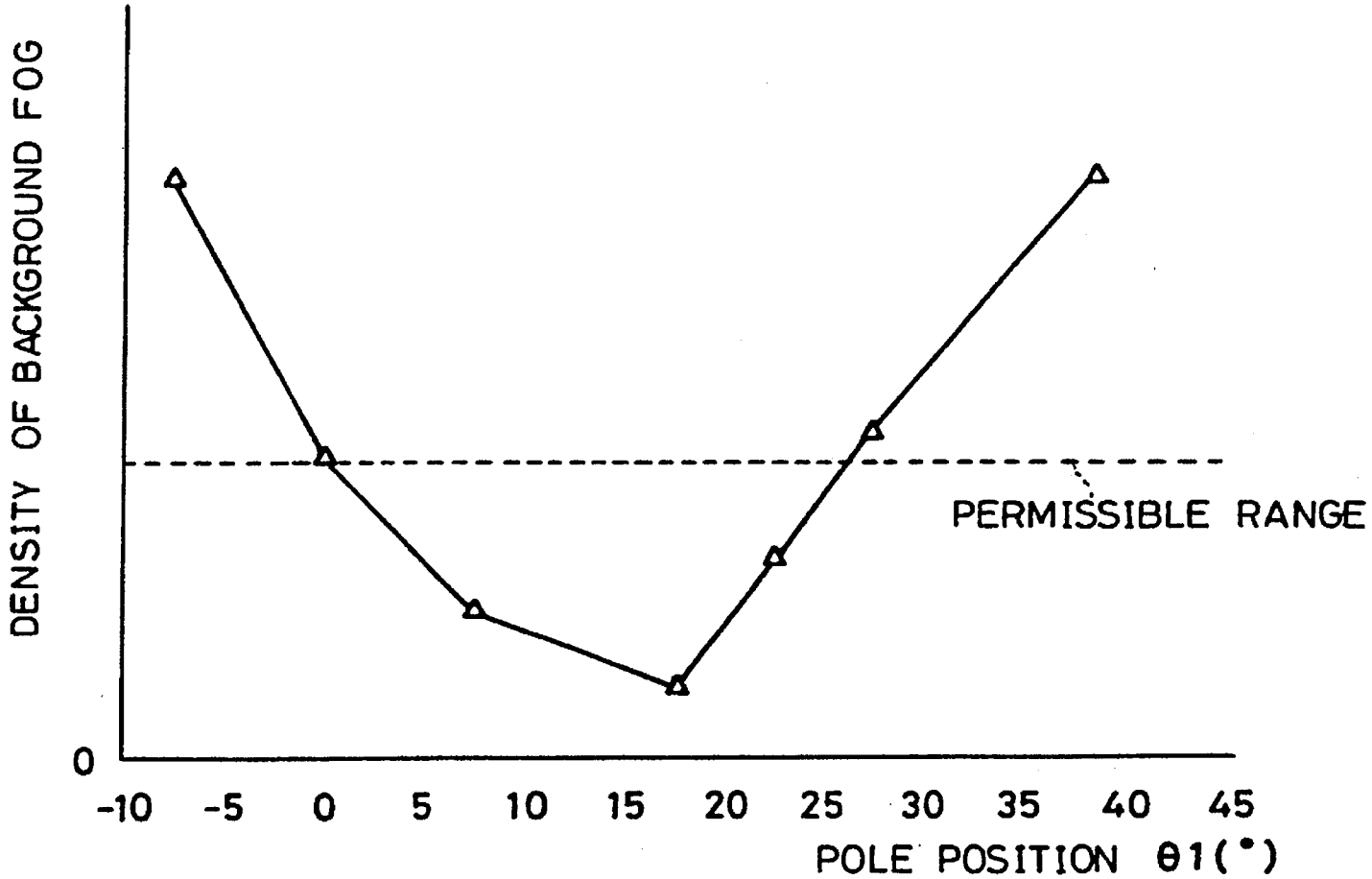
FIG. 7 is a graph showing the relationship between a position of a magnetic pole and a charged voltage, or potential in the FIG. 5 embodiment.

FIG. 7 is a graph showing a relationship between a position of the magnetic pole N1 and the background fog density. The position of the magnetic pole N1 is represented by the angle θ1. It will be understood that the background fog becomes small within the angle range of θ to +22.5 degrees, that is, the angle range wherein the relationship of θ1≦θ2 is obtained.

Furthermore, if the magnetic pole is arranged at a developing agent supplying portion, flowability of the developing agent in this portion becomes bad, and therefore, the developing agent is accumulated at the upstream side along the surface of the photoreceptor 12. The magnetic restriction force due to the magnetic roller 24 with respect to the developing agent 18 as accumulated becomes weak, and therefore, the developing agent 18 becomes easy to be scattered. Then, in this embodiment, the precharger 28 is arranged such that the same is brought into close contact to the accumulated developing agent as shown in FIG. 5 and FIG. 6. Since the precharger 28 includes a conductive film as described above, the precharger 28 can be flexibly changed in its position according to an increase or decrease of the amount of the accumulated developing agent. Therefore, in this embodiment, the precharger 28 demonstrates a scattering preventing function for the developing agent.

In addition, in the above described embodiments, a back exposure recording system is described; however, the present invention can be applied to a system where the photoreceptor is exposed from the outside. More specifically, in a system where the photoreceptor 12 is exposed from the outside between the precharger 28 and the developing unit 16, by setting the charging voltage of the precharger 28 and the developing bias voltage of the developing unit 16, respectively, and by uniformalizing the nonuniformity of charge by the precharger 28 by means of the magnetic brush 34 of the developing unit 16, it is possible to reduce the background fog. At this time, due to the charging injection performed by the magnetic brush 34 of the developing unit 16, the charged potential of the photoreceptor 12 after exposure is increased; however, if a difference between the developing voltage, i.e. the developing bias voltage and the charged voltage of the photoreceptor 12 after exposure is made large, it is possible to make the charged voltage of the photoreceptor 12 after exposure smaller than the developing bias voltage, and therefore, toner developing becomes possible.

Figure 8:
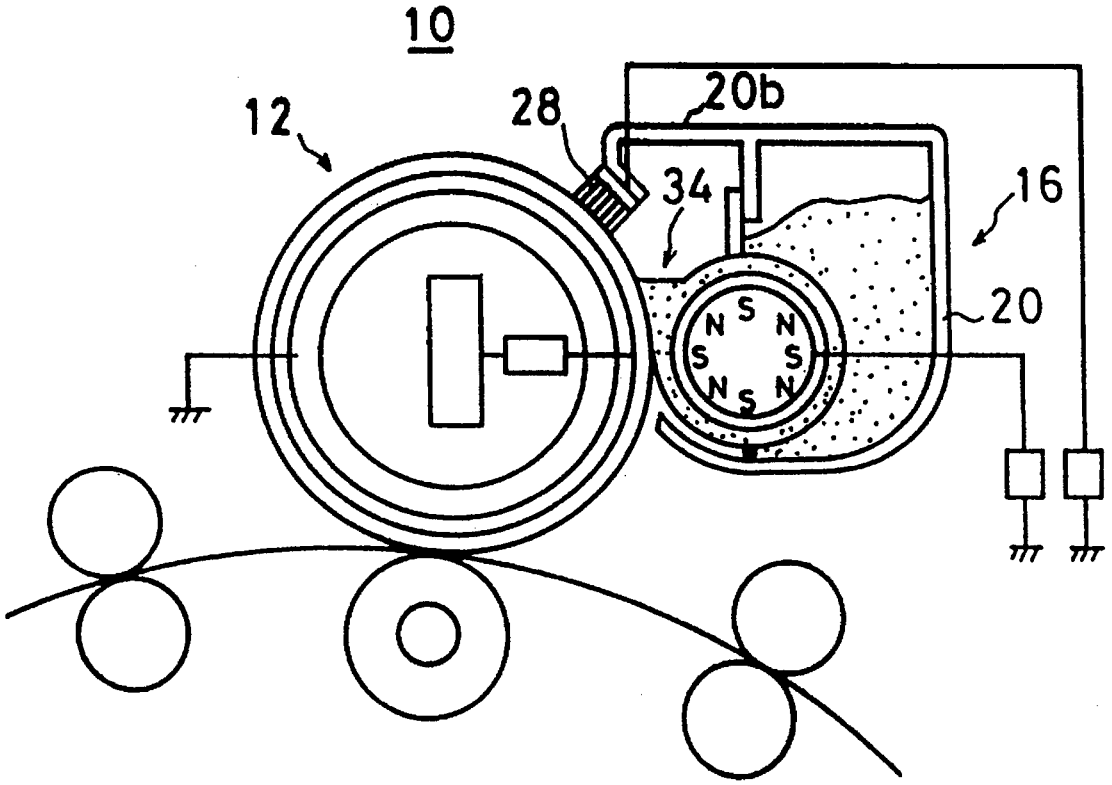
FIG. 8 is an illustrative view showing another embodiment according to the present invention.

An image forming apparatus 10 of the embodiment shown in FIG. 8 includes a conductive brush as the precharger 28. The conductive brush is attached to an upper end 20*b* of the toner box 20. In this embodiment, since the precharger 28 is constructed by the conductive brush, the above described remaining toner separating function can be further demonstrated. That is, when the remaining toner adhered to the photoreceptor 12 is passed through the precharger 28, i.e. the conductive brush, the remaining toner is disturbed by the conductive brush. Therefore, the restoration of the remaining toner by the magnetic brush 34 can be performed more surely.

Figure 9:
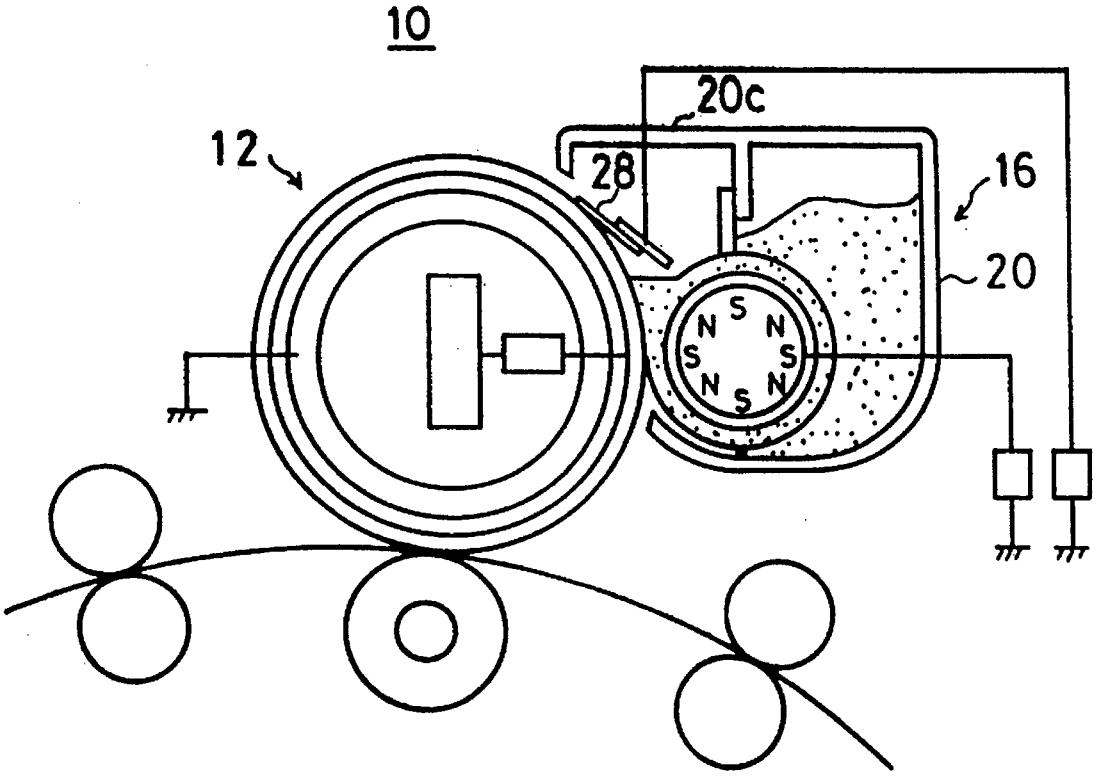
FIG. 9 is an illustrative view showing another embodiment according to the present invention.

In the embodiment shown in FIG. 9, the precharger 28 is formed by a conductive blade, and the precharger 28 of the conductive blade is covered by an upper end 20*c* of the toner box 20. That is, in this embodiment, the precharger 28 is accommodated within the toner box 20. By accommodating the precharger 28 within the toner box 20, the scattering of the developing agent can be prevented, and the restoration of the remaining toner can be performed more surely.

Figure 10:
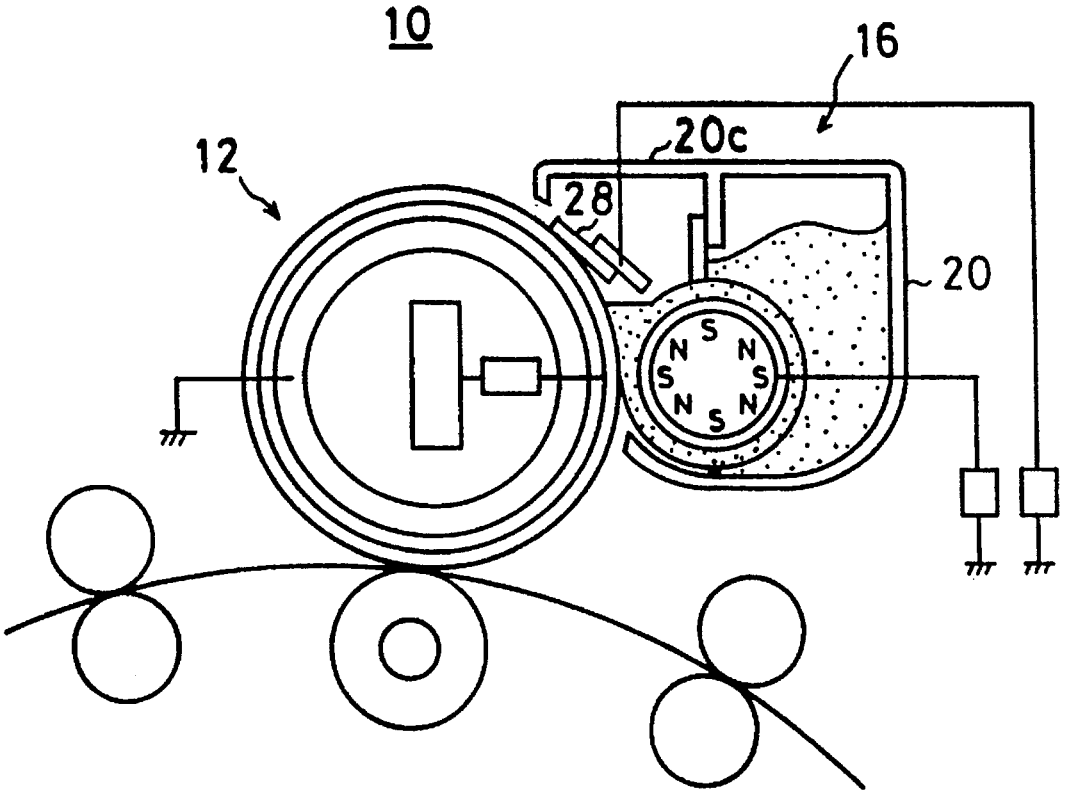
FIG. 10 is an illustrative view showing another embodiment according to the present invention.

The embodiment shown in FIG. 10 is similar to FIG. 9 except that the precharger 28 is formed by a conductive plate.

Figure 11:
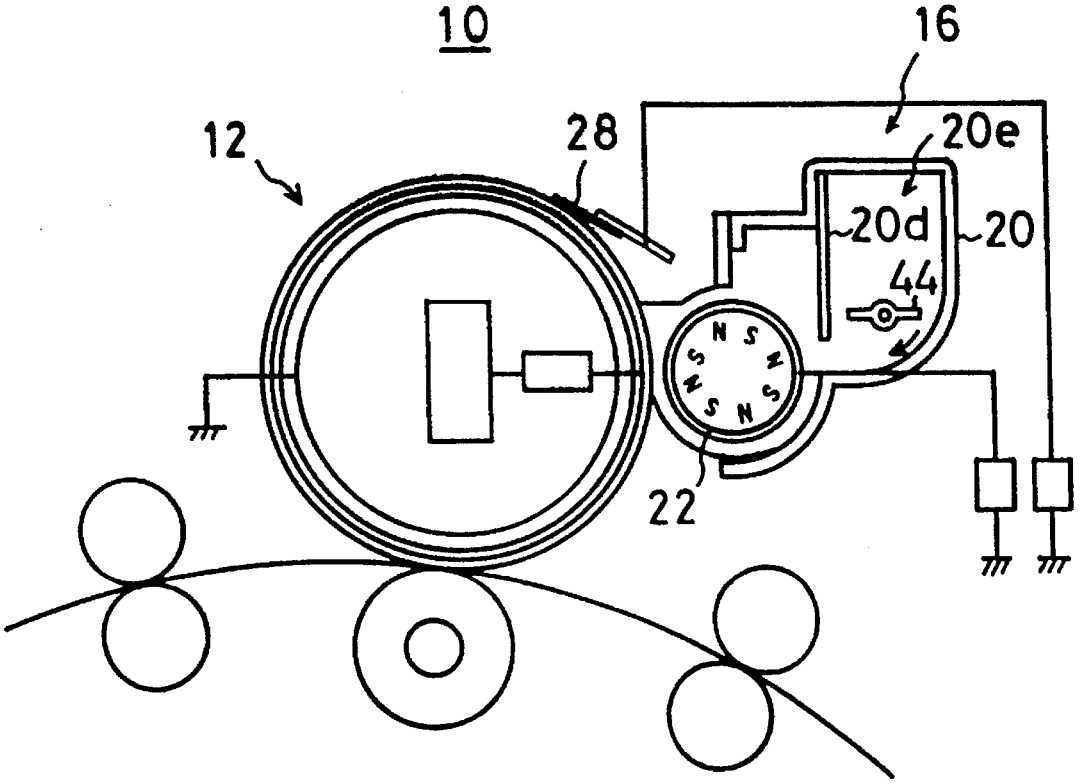
FIG. 11 is an illustrative view showing another embodiment according to the present invention.

In the embodiment shown in FIG. 11, a partition 20*d* is arranged in the toner box 20, and a toner supplement portion 20*e* is formed by the partition 20*d*. Then, an agitator 44 is arranged at a lower end opening of the toner supplement portion 20*e*. Therefore, the insulative toner refilled or supplemented into the toner supplement portion 20*e* is withdrawn according to the rotation of the agitator 44 to be brought to the developing sleeve 22.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus, comprising:

a photoreceptor which includes a substrate and a photoconductive layer on the substrate, at least a portion of said photoreceptor having an upstream side;

storing means in the vicinity of the surface of said photoconductive layer of said photoreceptor for storing a developing agent which is a mixture of an insulative toner and a semiconductive magnetic carrier;

developing means which brings said developing agent stored in said storing means into contact with said photoreceptor to charge said photoreceptor;

exposure means to irradiate an exposure light onto said photoconductive layer at a portion of said photoreceptor where said developing agent is brought into contact with said photoreceptor by said developing means;

developing bias means for applying a predetermined developing bias voltage between said developing means and said photoconductive layer; and precharger means substantially in contact with said photoreceptor at the upstream side from said developing means relative to said photoreceptor to apply a predetermined charging voltage to said photoreceptor prior to said photoreceptor being charged with developing agent by said developing means.

2. An image forming apparatus according to claim 1, wherein said substrate includes a transparent substrate, and said exposure means irradiates the exposure light to said photoconductive layer through said transparent substrate.

3. An image forming apparatus according to claim 1, wherein said precharger means applies said predetermined charging voltage having an absolute value more than an absolute value of said developing bias voltage to said photoreceptor.

4. An image forming apparatus according to claim 3, wherein said precharger means applies said predetermined charging voltage to said photoreceptor by which a charged potential of said photoreceptor larger than said developing bias voltage is obtained by said photoreceptor.

5. An image forming apparatus according to claim 1, wherein said photoreceptor includes a cylindrical photoreceptor having a center, and said developing means includes a magnetic roller having a center and a first magnetic pole and a second magnetic pole alternately arranged on an outer peripheral surface thereof, and a developing sleeve covering said magnetic roller in a rotatable manner, and said first magnetic pole and said second magnetic pole being arranged at an upper portion and a lower portion on opposite sides of a first linear line connecting said center of said cylindrical photoreceptor and said center of said magnetic roller, and a first angle formed by a second linear line connecting said first magnetic pole and said center of said magnetic roller with said first linear line being larger than a second angle formed by a third linear line connecting said second magnetic pole and said center of said magnetic roller with said first linear line.

6. An image forming apparatus according to claim 1, wherein said precharger means is arranged at a position separated from said developing means by a first distance.

7. An image forming apparatus according to claim 6, wherein said precharger means is arranged at a position separated from said developing means by a second distance shorter than said first distance.

8. An image forming apparatus according to claim 7, wherein developing agent is accumulated at the upstream side from said developing means between said developing means and said photoreceptor, and said precharger means includes a conductive member which has flexibility and is in contact with or close to said accumulated developing agent, and said conductive member functions as a scattering preventing member for said developing agent.

9. An image forming apparatus according to claim 1, wherein said precharger means includes a conductive sheet functioning as a remaining toner separating member for separating toner remaining on said photoreceptor from said photoreceptor.

10. An image forming apparatus according to claim 1, wherein said precharger means includes a conductive blade functioning as a remaining toner separating member for separating toner remaining on said photoreceptor from said photoreceptor.

11. An image forming apparatus according to claim 1, wherein said precharger means includes a conductive brush functioning as a remaining toner separating member for separating toner remaining on said photoreceptor from said photoreceptor.

12. An image forming apparatus according to claim 1, wherein said developing means includes a housing accommodating said precharger means therein.

13. An image forming apparatus according to claim 1, wherein said semiconductive magnetic carrier has a resistivity of $10^4$–$10^8\Omega\cdot$cm.

14. An image forming apparatus according to claim 13, wherein said semiconductive magnetic carrier has a resistivity of $10^5$–$10^7\Omega\cdot$cm.

15. An image forming apparatus according to claim 1, wherein said semiconductive magnetic carrier has an average particle diameter of 20–50 μ m.

* * * * *